US011185735B2

(12) United States Patent
Arn et al.

(10) Patent No.: US 11,185,735 B2
(45) Date of Patent: Nov. 30, 2021

(54) SYSTEM, METHOD AND APPARATUS FOR ADJUSTABLE PEDAL CRANK

(71) Applicant: ROM TECHNOLOGIES, INC., Brookfield, CT (US)

(72) Inventors: Peter Arn, Roxbury, CT (US); Nick Samiotes, Mashpee, MA (US); Paul DiCesare, Shelton, CT (US); Danial Ferreira, Woodbridge, CT (US)

(73) Assignee: ROM TECHNOLOGIES, INC., Brookfield, CT (US)

( * ) Notice: Subject to any disclaimer, the term of this patent is extended or adjusted under 35 U.S.C. 154(b) by 23 days.

(21) Appl. No.: 16/812,462

(22) Filed: Mar. 9, 2020

(65) Prior Publication Data

US 2020/0289878 A1 Sep. 17, 2020

Related U.S. Application Data

(60) Provisional application No. 62/816,531, filed on Mar. 11, 2019.

(51) Int. Cl.
*A63B 22/06* (2006.01)
*A63B 23/04* (2006.01)

(52) U.S. Cl.
CPC ..... *A63B 22/0605* (2013.01); *A63B 23/0476* (2013.01); *A63B 2022/0623* (2013.01)

(58) Field of Classification Search
CPC ..... A63B 22/0605; A63B 23/0476; A63B 2022/0623; A63B 21/00181;
(Continued)

(56) References Cited

U.S. PATENT DOCUMENTS 59,915 A 11/1866 Lallement
363,522 A 5/1887 Knous
(Continued)

FOREIGN PATENT DOCUMENTS

CA 2698078 A1 3/2010
CN 112603295 A 2/2003
(Continued)

OTHER PUBLICATIONS

Fysiomed, "16983—Vario adjustable pedal arms", <https://www.fysiomed.com/en/products/16983-vario-adjustable-pedal-arms>, pulled from webpage on Aug. 4, 2020; 1 page.
(Continued)

*Primary Examiner* — Andrew S Lo
*Assistant Examiner* — Andrew M Kobylarz
(74) *Attorney, Agent, or Firm* — Dickinson Wright, PLLC; Stephen A. Mason; Jonathan H. Harder

(57) ABSTRACT

A pedal assembly for an exercise and rehabilitation device can include a disk having an axis of rotation. A central aperture can be formed in the disk along the axis. Spokes can extend radially from adjacent the central aperture toward a perimeter of the disk. The disk can be formed from a first material. In addition, a crank can be coupled to one of the spokes of the disk. The crank can have a hub concentric with the central aperture. Pedal apertures can extend along a radial length of the crank. The crank can be formed from a metallic material that differs from the first material. A pedal having a spindle can be interchangeably and releasably mounted to the pedal apertures in the crank.

18 Claims, 7 Drawing Sheets

(58) Field of Classification Search
CPC ..... A63B 71/0622; A63B 21/4034; A63B 2209/00; A63B 2210/50; A61H 1/0237; A61H 2201/0192; A61H 2205/12; A61H 2201/164; A61H 2201/0157; A61H 2205/06; A61H 2205/065; A61H 2205/10; A61H 2201/1671; A61H 1/00
See application file for complete search history.

(56) References Cited

U.S. PATENT DOCUMENTS 446,671 A 2/1891 Elliott
610,157 A 8/1898 Campbell
631,276 A 8/1899 Bulova
823,712 A 6/1906 Uhlmann
1,149,029 A 8/1915 Clark
1,227,743 A 5/1917 Burgedorfp
1,784,230 A 12/1930 Freeman
3,081,645 A 3/1963 Bergfors
3,100,640 A 8/1963 Weitzel
3,137,014 A 6/1964 Meucci
3,143,316 A 8/1964 Shapiro
3,713,438 A 1/1973 Knutsen
3,744,480 A 7/1973 Gause et al.
3,888,136 A 6/1975 Lapeyre
4,079,957 A 3/1978 Blease
4,408,613 A 10/1983 Relyea
4,436,097 A 3/1984 Cunningham
4,446,753 A 5/1984 Nagano
4,477,072 A 10/1984 DeCloux
4,499,900 A 2/1985 Petrofsky et al.
4,509,742 A 4/1985 Cones
4,606,241 A 8/1986 Fredriksson
4,611,807 A 9/1986 Castillo
4,616,823 A 10/1986 Yang
4,648,287 A 3/1987 Preskitt
4,673,178 A 6/1987 Dwight
4,824,104 A 4/1989 Bloch
4,850,245 A 7/1989 Feamster et al.
4,858,942 A 8/1989 Rodriguez
4,869,497 A 9/1989 Stewart et al.
4,915,374 A 4/1990 Watkins
4,930,768 A 6/1990 Lapcevic
4,961,570 A 10/1990 Chang
5,161,430 A 11/1992 Febey
5,202,794 A 4/1993 Schnee et al.
5,247,853 A 9/1993 Dalebout
5,282,748 A 2/1994 Little
5,316,532 A 5/1994 Butler
5,324,241 A 6/1994 Artigues et al.
5,336,147 A 8/1994 Sweeney, III
5,338,272 A 8/1994 Sweeney, III
5,361,649 A 11/1994 Slocum, Jr.
D353,421 S 12/1994 Gallivan
5,458,022 A 10/1995 Mattfeld et al.
5,487,713 A 1/1996 Butler
5,566,589 A * 10/1996 Buck ..... B62M 3/02 403/104
5,580,338 A 12/1996 Scelta et al.
5,676,349 A 10/1997 Wilson
5,685,804 A 11/1997 Whan-Tong et al.
5,860,941 A 1/1999 Saringer et al.
5,950,813 A 9/1999 Hoskins et al.
6,053,847 A 4/2000 Stearns et al.
6,077,201 A 6/2000 Cheng
6,102,834 A 8/2000 Chen
6,155,958 A 12/2000 Goldberg
6,182,029 B1 1/2001 Friedman
6,253,638 B1 7/2001 Bermudez
6,371,891 B1 4/2002 Speas
6,413,190 B1 7/2002 Wood et al.
6,430,436 B1 8/2002 Richter
6,474,193 B1 11/2002 Farney
6,491,649 B1 12/2002 Ombrellaro
6,543,309 B2 4/2003 Heim
D475,424 S 6/2003 Lee
6,589,139 B1 7/2003 Butterworth
D482,416 S 11/2003 Yang
6,640,662 B1 11/2003 Baxter
D484,931 S 1/2004 Tsai
6,820,517 B1 11/2004 Farney
6,865,969 B2 3/2005 Stevens
6,895,834 B1 5/2005 Baal
7,169,085 B1 1/2007 Killin et al.
7,204,788 B2 4/2007 Andrews
7,209,886 B2 4/2007 Kimmel
7,226,394 B2 6/2007 Johnson
7,406,003 B2 7/2008 Burkhardt et al.
D575,836 S 8/2008 Hsiao
7,594,879 B2 9/2009 Johnson
7,726,034 B2 6/2010 Wixey
7,974,689 B2 7/2011 Volpe et al.
8,506,458 B2 8/2013 Dugan
8,556,778 B1 10/2013 Dugan
8,607,465 B1 12/2013 Edwards
8,672,812 B2 3/2014 Dugan
8,751,264 B2 6/2014 Beraja et al.
8,784,273 B2 7/2014 Dugan
8,823,448 B1 9/2014 Shen
8,979,711 B2 3/2015 Dugan
9,272,185 B2 3/2016 Dugan
9,311,789 B1 4/2016 Gwin
9,409,054 B2 8/2016 Dugan
9,480,873 B2 11/2016 Chuang
9,566,472 B2 2/2017 Dugan
D793,494 S 8/2017 Mansfield et al.
9,914,053 B2 3/2018 Dugan
9,919,198 B2 3/2018 Romeo et al.
9,937,382 B2 4/2018 Dugan
9,939,784 B1 4/2018 Berardinelli
10,130,298 B2 11/2018 Mokaya et al.
10,155,134 B2 12/2018 Dugan
10,254,804 B2 4/2019 Dusan
10,424,033 B2 9/2019 Romeo
10,576,331 B2 3/2020 Kuo
10,705,619 B2 7/2020 Johri
11,040,238 B2 6/2021 Colburn
2002/0160883 A1 10/2002 Dugan
2003/0036683 A1 2/2003 Kehr et al.
2003/0083596 A1 5/2003 Kramer et al.
2003/0092536 A1 5/2003 Romanelli et al.
2003/0109814 A1 6/2003 Rummerfield
2004/0106502 A1 6/2004 Sher
2004/0172093 A1 9/2004 Rummerfield
2004/0194572 A1 10/2004 Kim
2005/0020411 A1 1/2005 Andrews
2005/0049122 A1 3/2005 Vallone et al.
2005/0085346 A1 4/2005 Johnson
2005/0085353 A1 4/2005 Johnson
2005/0274220 A1 12/2005 Reboullet
2006/0003871 A1 1/2006 Houghton
2006/0064329 A1 3/2006 Abolfathi et al.
2006/0247095 A1 11/2006 Rummerfield
2008/0161166 A1 7/2008 Lo
2009/0011907 A1 1/2009 Radow et al.
2009/0046056 A1 2/2009 Rosenberg et al.
2009/0070138 A1 3/2009 Langheier et al.
2009/0211395 A1 8/2009 Mul'e
2010/0248905 A1 9/2010 Lu
2010/0268304 A1 10/2010 Matos
2011/0172059 A1 7/2011 Watterson et al.
2011/0218814 A1 9/2011 Coats
2011/0275483 A1 11/2011 Dugan
2012/0065987 A1 3/2012 Farooq et al.
2012/0167709 A1 7/2012 Chen et al.
2012/0190502 A1 7/2012 Paulus et al.
2012/0310667 A1 12/2012 Altman et al.
2013/0123667 A1 5/2013 Komatireddy et al.
2013/0296987 A1 11/2013 Rogers et al.
2014/0006042 A1 1/2014 Keefe et al.
2014/0011640 A1 1/2014 Dugan
2014/0155129 A1 6/2014 Dugan
2014/0188009 A1 7/2014 Lange et al.
2014/0194250 A1 7/2014 Reich et al.

(56) References Cited

U.S. PATENT DOCUMENTS

| | | | |
|---|---|---|---|
| 2014/0257837 | A1 | 9/2014 | Walker et al. |
| 2014/0309083 | A1 | 10/2014 | Dugan |
| 2014/0322686 | A1 | 10/2014 | Kang |
| 2015/0088544 | A1 | 3/2015 | Goldberg |
| 2015/0151162 | A1 | 6/2015 | Dugan |
| 2015/0161331 | A1 | 6/2015 | Oleynik |
| 2015/0339442 | A1 | 11/2015 | Oleynik |
| 2016/0023081 | A1 | 1/2016 | Popa-Simil |
| 2016/0140319 | A1 | 5/2016 | Stark et al. |
| 2016/0151670 | A1 | 6/2016 | Dugan |
| 2016/0166881 | A1 | 6/2016 | Ridgel et al. |
| 2016/0275259 | A1 | 9/2016 | Nolan et al. |
| 2016/0302721 | A1 | 10/2016 | Wiedenhoefer et al. |
| 2016/0317869 | A1 | 11/2016 | Dugan |
| 2017/0004260 | A1 | 1/2017 | Moturu et al. |
| 2017/0014671 | A1 | 1/2017 | Burns, Sr. |
| 2017/0106242 | A1 | 4/2017 | Dugan |
| 2017/0113092 | A1* | 4/2017 | Johnson ..... A63B 21/225 |
| 2017/0143261 | A1 | 5/2017 | Wiedenhoefer et al. |
| 2017/0147789 | A1 | 5/2017 | Wiedenhoefer et al. |
| 2017/0181698 | A1 | 6/2017 | Wiedenhoefer et al. |
| 2017/0243028 | A1 | 8/2017 | LaFever et al. |
| 2017/0265800 | A1 | 9/2017 | Auchinleck et al. |
| 2017/0278209 | A1 | 9/2017 | Olsen et al. |
| 2017/0300654 | A1 | 10/2017 | Stein et al. |
| 2017/0329917 | A1 | 11/2017 | McRaith et al. |
| 2017/0344726 | A1 | 11/2017 | Duffy et al. |
| 2017/0360586 | A1 | 12/2017 | Dempers et al. |
| 2018/0052962 | A1 | 2/2018 | Van Der Koijk et al. |
| 2018/0071565 | A1 | 3/2018 | Gomberg et al. |
| 2018/0071566 | A1 | 3/2018 | Gomberg et al. |
| 2018/0071569 | A1 | 3/2018 | Gomberg et al. |
| 2018/0071570 | A1 | 3/2018 | Gomberg et al. |
| 2018/0071571 | A1 | 3/2018 | Gomberg et al. |
| 2018/0071572 | A1 | 3/2018 | Gomberg et al. |
| 2018/0085615 | A1 | 3/2018 | Astolfi et al. |
| 2018/0102190 | A1 | 4/2018 | Hogue et al. |
| 2018/0200577 | A1 | 7/2018 | Dugan |
| 2018/0240552 | A1 | 8/2018 | Tuyl et al. |
| 2018/0271432 | A1 | 9/2018 | Auchinleck et al. |
| 2018/0280784 | A1 | 10/2018 | Romeo et al. |
| 2018/0330824 | A1 | 11/2018 | Athey et al. |
| 2019/0019578 | A1 | 1/2019 | Vaccaro |
| 2019/0035043 | A1 | 1/2019 | Jones et al. |
| 2019/0066832 | A1 | 2/2019 | Kang et al. |
| 2019/0076701 | A1 | 3/2019 | Dugan |
| 2019/0167988 | A1 | 6/2019 | Shahriari et al. |
| 2019/0304584 | A1 | 10/2019 | Savolainen |
| 2019/0307983 | A1 | 10/2019 | Goldman |
| 2019/0354632 | A1 | 11/2019 | Mital et al. |
| 2020/0005928 | A1 | 1/2020 | Daniel |
| 2020/0051446 | A1 | 2/2020 | Rubinstein et al. |
| 2020/0093418 | A1 | 3/2020 | Kluger et al. |
| 2020/0143922 | A1 | 5/2020 | Chekroud et al. |
| 2020/0151595 | A1 | 5/2020 | Jayalath et al. |
| 2020/0152339 | A1 | 5/2020 | Pulitzer et al. |
| 2020/0160198 | A1 | 5/2020 | Reeves et al. |
| 2020/0176098 | A1 | 6/2020 | Lucas et al. |
| 2020/0285322 | A1 | 9/2020 | Johri |
| 2020/0289878 | A1 | 9/2020 | Arn et al. |
| 2020/0289881 | A1 | 9/2020 | Hacking et al. |
| 2020/0289889 | A1 | 9/2020 | Hacking et al. |
| 2020/0293712 | A1 | 9/2020 | Potts et al. |
| 2020/0401224 | A1 | 12/2020 | Cotton |

FOREIGN PATENT DOCUMENTS

| | | | |
|---|---|---|---|
| CN | 202220794 | U | 5/2012 |
| EP | 2564904 | A1 | 3/2013 |
| JP | 6573739 | B1 | 9/2019 |
| KR | 20160093990 | A | 8/2016 |
| WO | 2020200891 | A1 | 2/2003 |
| WO | 2018132999 | A1 | 1/2017 |
| WO | 2019204876 | A1 | 4/2019 |
| WO | 2021021447 | A1 | 2/2021 |
| WO | 2021138620 | A1 | 7/2021 |

OTHER PUBLICATIONS

Matrix, "R3xm Recumbent Cycle", <https://www.matrixfitness.com/en/cardio/cycles/r3xm-recumbent>, pulled from webpage on Aug. 4, 2020; 1 page.

International Searching Authority, Search Report and Written Opinion for PCT/US2020/021876, dated May 28, 2020; 8 pages.

* cited by examiner

SYSTEM, METHOD AND APPARATUS FOR ADJUSTABLE PEDAL CRANK

CROSS-REFERENCE TO RELATED APPLICATIONS

This application claims priority to and the benefit of U.S. Prov. Pat. App. No. 62/816,531, filed Mar. 11, 2019, which is incorporated herein by reference in its entirety.

TECHNICAL FIELD

This application generally relates to adjustable exercise and/or rehabilitation equipment and, in particular, to a system, method and apparatus for an adjustable pedal crank.

STATEMENT OF FEDERALLY FUNDED RESEARCH

None.

BACKGROUND OF THE DISCLOSURE

Various devices are used by people for exercising and/or rehabilitating parts of their bodies. For example, to maintain a desired level of fitness, users may operate devices for a period of time as part of a workout regimen. In another example, a person may undergo knee surgery and a physician may provide a treatment plan for rehabilitation that includes operating a rehabilitation device for a period of time to strengthen and/or improve flexibility of parts of the body. The exercise and/or rehabilitation devices may include pedals on opposite sides. The devices may be operated by a user engaging the pedals with their feet or their hands and rotating the pedals. Although existing designs are workable, improvements in such equipment continue to be of interest.

SUMMARY OF THE DISCLOSURE

Embodiments of a system, method and apparatus fora pedal assembly for an exercise or rehabilitation device are disclosed. For example, the pedal assembly can include a crank having a hub with an axis of rotation. The crank can have a plurality of pedal apertures extending along a radial length of the crank. The crank can further include a locking plate that is slidably mounted to the crank. The locking plate can have a locked position wherein portions of the locking plate radially overlap portions of the pedal apertures, and an unlocked position wherein no portions of the locking plate radially overlap the pedal apertures. In addition, a pedal having a spindle can be interchangeably and releasably mounted to the pedal apertures in the crank.

Another embodiment of a pedal assembly for an exercise or rehabilitation device can include a disk having an axis of rotation. A central aperture can be formed in the disk along the axis. Spokes can extend radially from adjacent the central aperture toward a perimeter of the disk. The disk can be formed from a first material. In addition, a crank can be coupled to one of the spokes of the disk. The crank can have a hub concentric with the central aperture. Pedal apertures can extend along a radial length of the crank. The crank can be formed from a metallic material that differs from the first material. A pedal having a spindle can be interchangeably and releasably mounted to the pedal apertures in the crank.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description can be had by reference to the embodiments that are illustrated in the appended drawings. However, the drawings illustrate only some embodiments and are not to be considered limiting in scope since there can be other equally effective embodiments.

The use of the same reference symbols in different drawings indicates similar or identical items.

DETAILED DESCRIPTION OF THE DISCLOSURE

Figure 1:
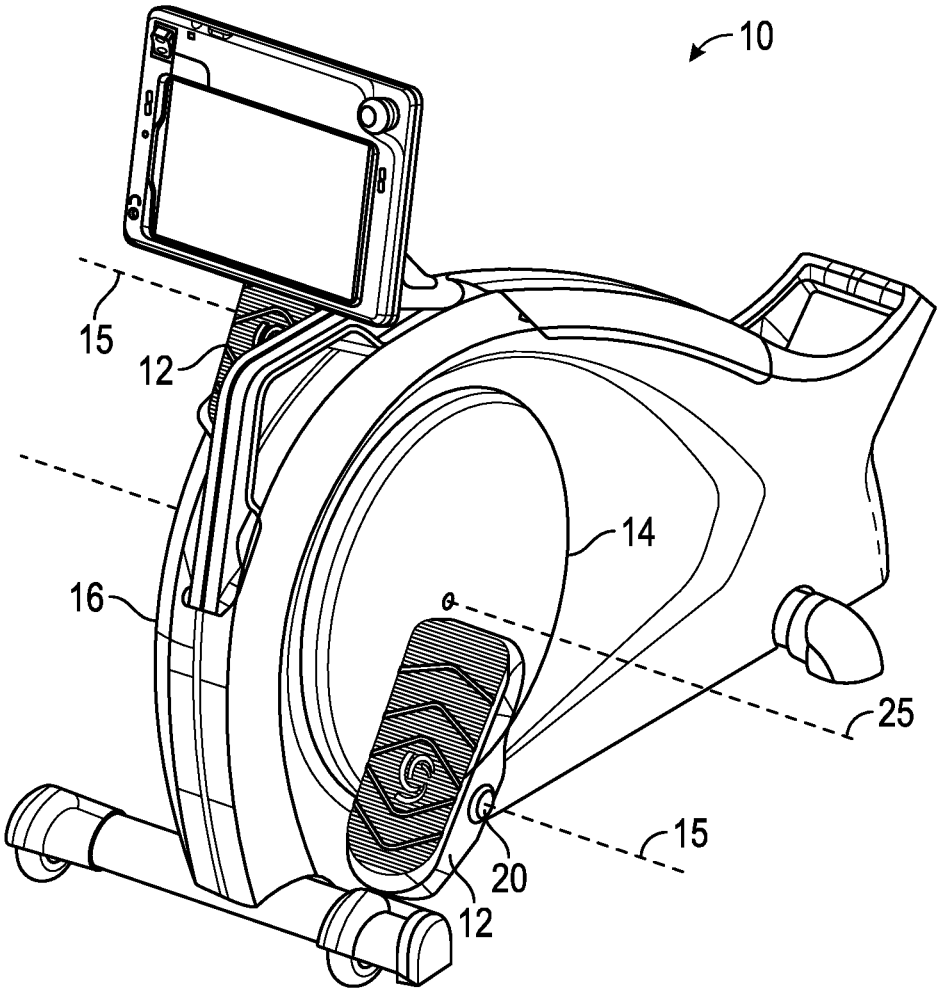
FIG. 1 is a schematic isometric view of an embodiment of an adjustable rehabilitation or exercise device.

U.S. Pat. No. 10,173,094, issued on Jan. 8, 2019, to Gomberg, et al., is incorporated herein by reference in its entirety.

FIGS. 1-6 depict various embodiments of a system, method and apparatus for a pedal assembly for a rehabilitation or exercise device. With initial reference to FIG. 1, there is shown an adjustable rehabilitation and/or exercise device 10 having patient engagement members, such as pedals 12 on opposite sides. The pedals 12 can be adjustably positioned relative to one another, but securely mounted to avoid disconnection, wobbling and the like experienced with some conventional devices.

Versions of the device 10 can include a rotary device such as a wheel 14 or flywheel or the like, rotatably mounted such as by a hub to a body or frame 16 or other support. The pedals 12 can be configured for interacting with a patient for exercise or rehabilitation. The pedals 12 can be configured for use with lower body extremities such as the feet or legs, or upper body extremities such as the hands, arms and the like. The pedals 12 can be a conventional bicycle pedal of the type having a foot support rotatably mounted onto an axle 20 with bearings. The axle 20 can have exposed end threads for engaging a mount on the wheel 14 to locate the pedal 12 on the wheel 14. The wheel 14 can be configured to have both pedals 12 on opposite sides of a single wheel. However, FIGS. 1A and 1B show a pair of the wheels 14 spaced apart from one another but interconnected to other components.

Embodiments of the rehabilitation and/or exercise device 10 of FIGS. 1A-1B can take the form as depicted, which can be portable. Alternatively, it can be non-portable such that it remains in a fixed location (e.g., at a rehabilitation clinic or medical practice). The device 10 can be configured to be a smaller and more portable unit so that it can be easily transported to different locations at which rehabilitation or treatment is to be provided, such as the homes of patients, alternative care facilities or the like.

Figure 2:
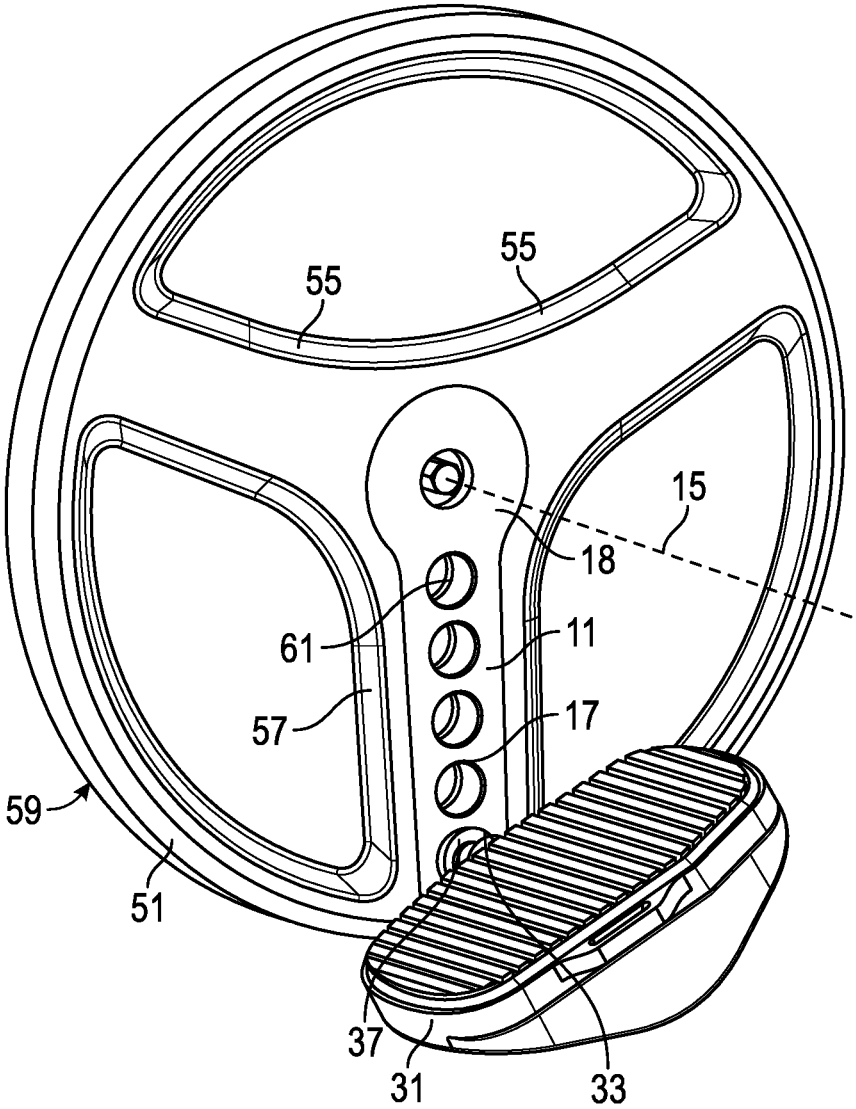
FIG. 2 is an isometric view of an embodiment of a pedal crank.
Figure 3:
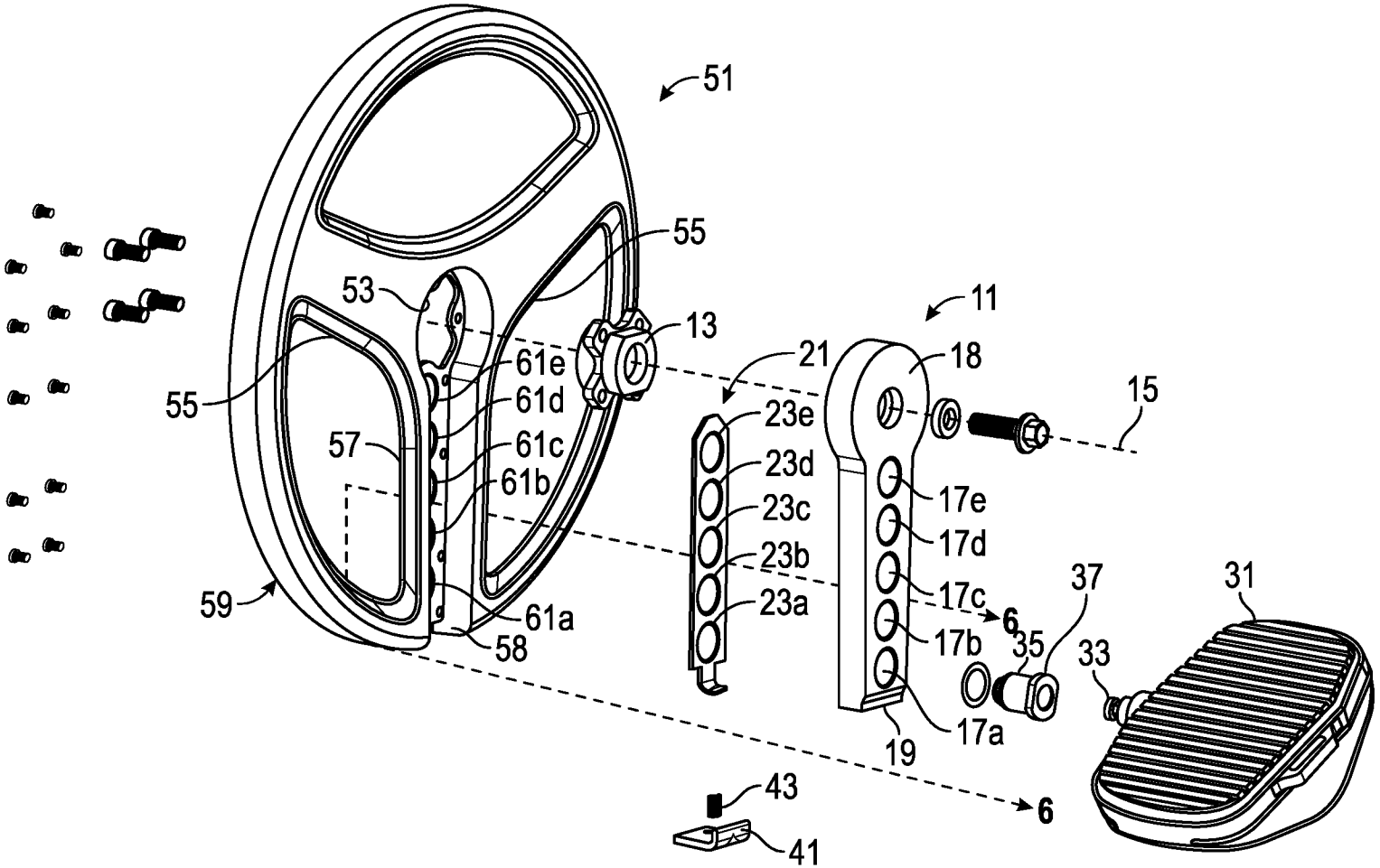
FIG. 3 is an exploded, isometric view of an embodiment of a pedal crank.

FIGS. 2 and 3 depict an embodiment of a pedal assembly including a disk 51 having an axis 15 of rotation. The disk 51 can include a central aperture 53 along the axis 15. A plurality of spokes 55, 57 can extend radially from adjacent the central aperture 53 toward a perimeter 59 of the disk 51. The disk 51 can be formed from a first material, such as a polymer. In one example, the polymer can comprise acrylonitrile butadiene styrene (ABS).

The pedal assembly can further include a crank 11. Examples of the crank 11 can be coupled to one of the spokes 57 of the disk 51. In some versions, only one of the spokes 57 of the disk 51 comprises a radial slot 58 (FIG. 3). Other ones of the spokes 55 of the disk 51 may or may not comprise a radial slot 58. The crank 11 can be mounted in the radial slot 58, as illustrated.

In some examples, the crank 11 can comprise a hub 13 that is concentric with the central aperture 53. The hub 13 can be detachable from the crank 11. The central aperture 53 can be complementary in shape to the hub 13, as shown. The crank 11 can be formed from a metallic material that differs from the first material used to form the disk 51. For example, the crank can comprise stainless steel 440C.

Figure 4:
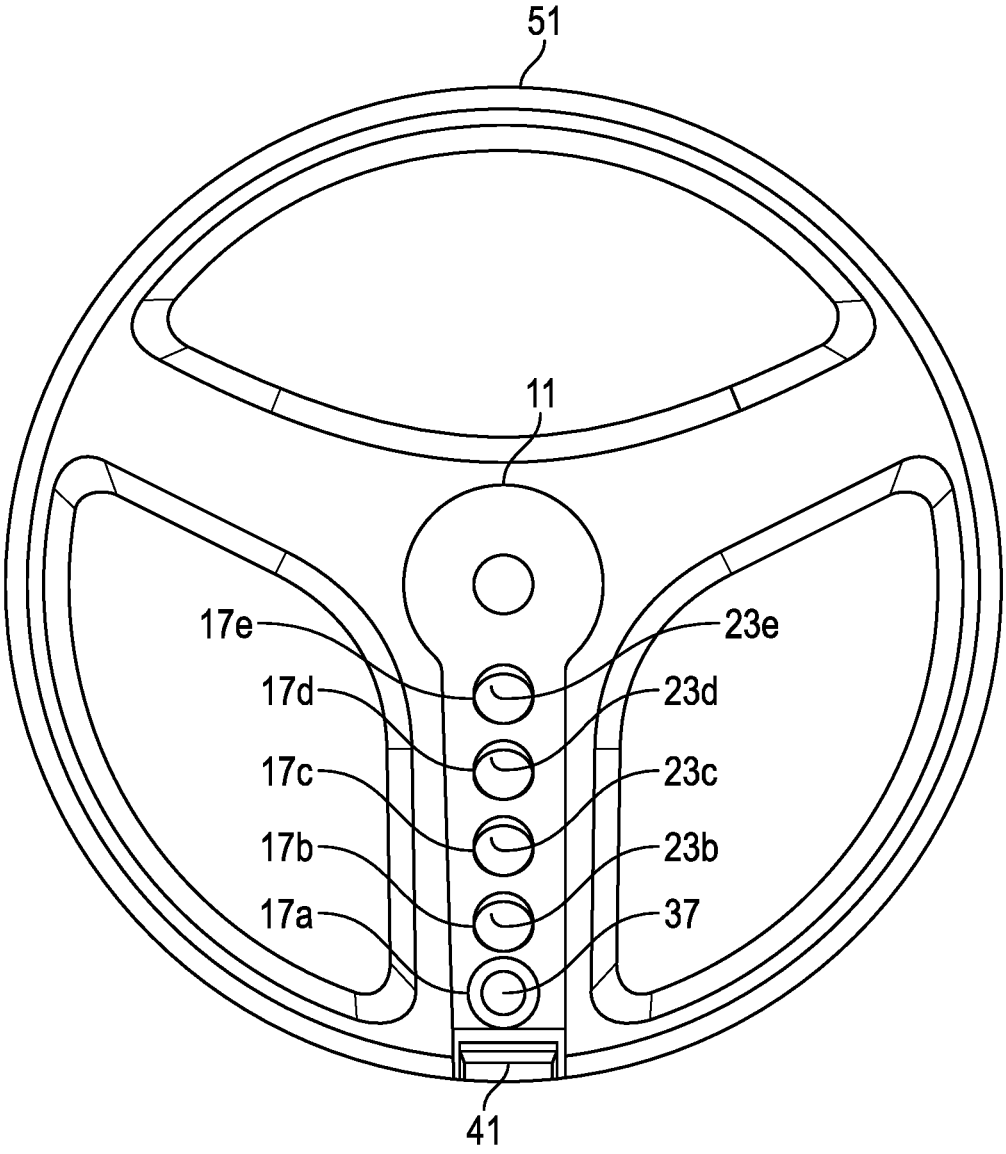
FIG. 4 is an axial view of an embodiment of a pedal crank.
Figure 5:
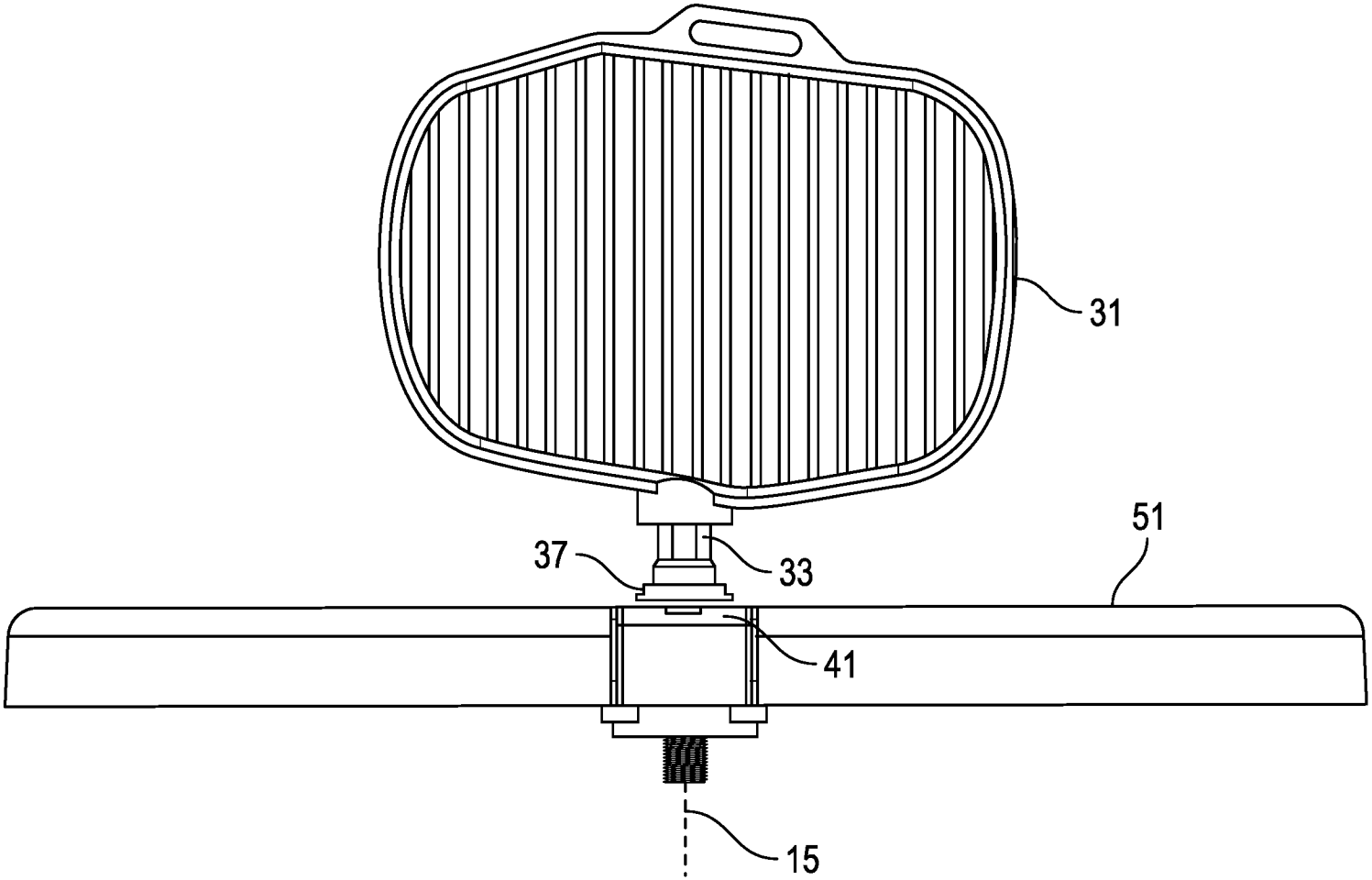
FIG. 5 is a radial view of an embodiment of a pedal crank.
Figure 6A:
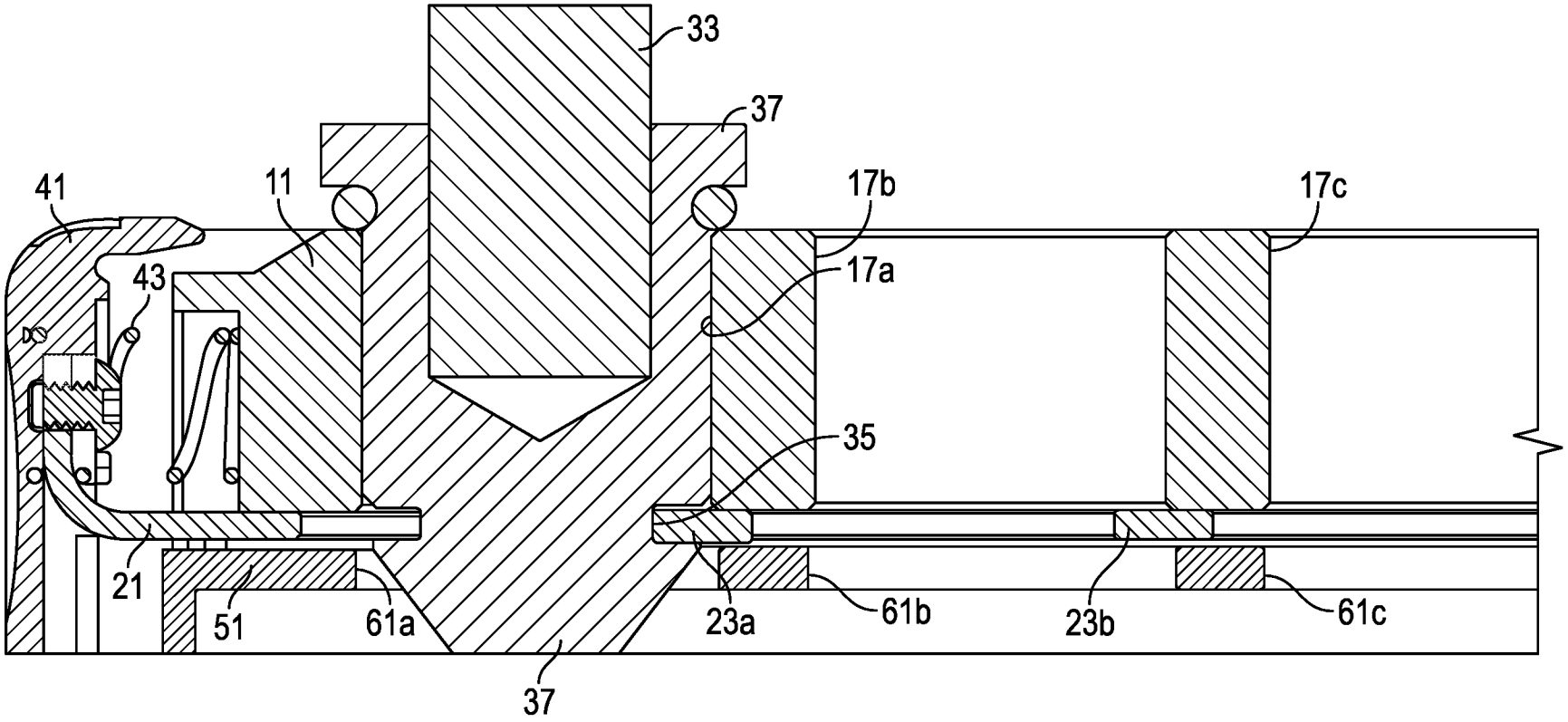
FIG. 6A is a sectional view of a portion of the pedal crank of FIG. 3, taken along the dashed line 6-6 in FIG. 3, with the lock plate in a default locked position.
Figure 6B:
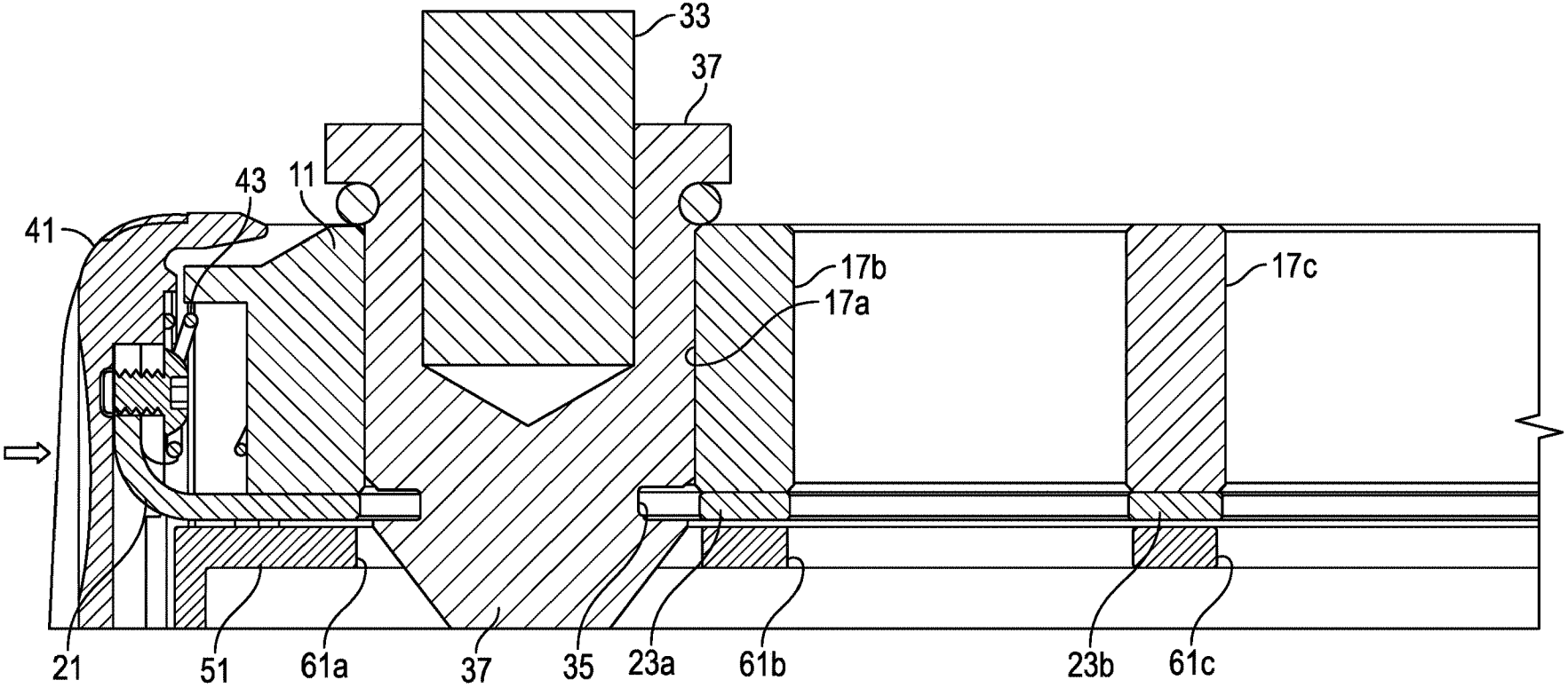
FIG. 6B is a sectional view of a portion of the pedal crank of FIG. 3, taken along the dashed line 6-6 in FIG. 3, with the lock plate in an unlocked position.

Embodiments of the crank 11 can include a plurality of holes or pedal apertures 17*a*-17*e* (FIGS. 3, 4, 6A and 6B) extending along a radial length of the crank 11. Although five pedal apertures 17*a*-17*e* are illustrated, the crank could have fewer or more of them. As shown in FIGS. 2 and 5, a pedal 31 can be coupled to the crank 11 via a spindle 33. The pedal 31 can be configured to be interchangeably and releasably mounted to the pedal apertures 17*a*-17*e* in the crank 11. In addition, the disk 51 can include holes of disk pedal apertures 61*a*-61*e* (FIGS. 3, 6A and 6B). The disk pedal apertures 61*a*-61*e* can be coaxial and not obstructed (i.e., unobstructed) by respective ones of the pedal apertures 17*a*-17*e* of the crank 11. In some versions, the disk 51 can be solid, other than at the central aperture 53, disk pedal apertures 61*a*-61*e* and the fastener apertures as shown in the drawings.

Versions of the pedal assembly can include the crank 11 with a locking plate 21 (FIG. 3). The locking plate 21 can be slidably mounted to the crank 11. As shown in FIGS. 4 and 6A, examples of the locking plate 21 can include a locked position (FIG. 4) wherein portions 23*a*-23*e* of the locking plate radially overlap portions of the pedal apertures 17*a*-17*e* (and, e.g., the disk pedal apertures 61*a*-61*e*). In some versions (compare FIG. 6B), the locking plate 21 can include an unlocked position (FIG. 2) wherein no portions of the locking plate 21 radially overlap the pedal apertures 17*a*-17*e* (and, e.g., the disk pedal apertures 61*a*-61*e*).

In some embodiments, when moving between the locked and unlocked positions, the portions 23*a*-23*e* of the locking plate 21 can simultaneously overlap and retract from the pedal apertures 17*a*-17*e* (and, e.g., the disk pedal apertures 61*a*-61*e*). The term "simultaneous" can be defined and understood as including less than perfect, mathematically precise, identical movements, such as substantially or effectively simultaneous. In the unlocked position, examples of the disk pedal apertures 61*a*-61*e* can be coaxial and not obstructed (i.e., unobstructed) by the portions 23*a*-23*e* of the locking plate 21 of the crank 11.

As shown in FIGS. 2 and 3, some examples of the pedal assembly can include the circumferential slot 35 being formed in a pedal pin 37 (FIGS. 6A and 6B) that is mounted to the spindle 33. In one version, the spindle 33 has a circumferential slot 35 (Not Shown) for selectively engaging the portions 23*a*-23*e* of the locking plate 21 adjacent to the pedal apertures 17*a*-17*e*.

Embodiments of the locking plate 21 can default to the locked position. In one version, the locking plate 21 can default to the locked position by spring bias against the crank 11. For example, the locking plate 21 can include a plunger 41 (FIGS. 3, 6A and 6B) that can be actuated by a spring 43 adjacent to a radial perimeter 19 of the crank 11.

Still other versions can include one or more of the following embodiments.

1. A pedal assembly for an exercise and rehabilitation device, the pedal assembly comprising:

a crank having a hub with an axis of rotation, a plurality of pedal apertures extending along a radial length of the crank, and a locking plate that is slidably mounted to the crank, the locking plate having a locked position wherein portions of the locking plate radially overlap portions of the pedal apertures, and an unlocked position wherein no portions of the locking plate radially overlap the pedal apertures; and a pedal having a spindle configured to be interchangeably and releasably mounted to the pedal apertures in the crank.

2. The pedal assembly of any of these embodiments wherein, when moving between the locked and unlocked positions, the portions of the locking plate simultaneously overlap and retract from the pedal apertures, respectively.

3. The pedal assembly of any of these embodiments, wherein the locking plate defaults to the locked position by spring bias against the crank.

4. The pedal assembly of any of these embodiments, further comprising a plunger and a spring for actuating the locking plate adjacent a radial perimeter of the crank.

5. The pedal assembly of any of these embodiments, wherein the spindle comprises a circumferential slot for selectively engaging the locking plate adjacent to the pedal apertures.

6. The pedal assembly of any of these embodiments, wherein the circumferential slot is formed in a pedal pin that is mounted to the spindle.

7. The pedal assembly of any of these embodiments, further comprising a disk coaxial with the axis of rotation, a central aperture along the axis and a plurality of spokes extending radially from adjacent the central aperture toward a perimeter of the disk, and the disk is formed from a different material than the crank; and the crank is coupled to one of the spokes of the disk.

8. The pedal assembly of any of these embodiments, wherein the disk has disk pedal apertures that are coaxial and not obstructed by the pedal apertures of the crank; and the crank is mounted in a radial slot of one of the spokes.

9. A pedal assembly for an exercise and rehabilitation device, the pedal assembly comprising:

a disk having an axis of rotation, a central aperture along the axis and a plurality of spokes extending radially from adjacent the central aperture toward a perimeter of the disk, and the disk is formed from a first material; and a crank coupled to one of the spokes of the disk, the crank having a hub concentric with the central aperture, and a plurality of pedal apertures extending along a radial length of the crank, and the crank is formed from a metallic material that differs from the first material; and a pedal having a spindle configured to be interchangeably and releasably mounted to the pedal apertures in the crank.

10. The pedal assembly of any of these embodiments, wherein the disk has disk pedal apertures that are coaxial and not obstructed by the pedal apertures of the crank.

11. The pedal assembly of any of these embodiments, wherein the first material comprises a polymer.

12. The pedal assembly of any of these embodiments, wherein only one of the spokes of the disk comprises a radial slot, the crank is mounted in the radial slot, and other ones of the spokes of the disk do not comprise a radial slot.

13. The pedal assembly of any of these embodiments, wherein the central aperture is complementary in shape to the hub, and the hub is detachable from the crank.

14. The pedal assembly of any of these embodiments, wherein the disk is solid other than at the central aperture, disk pedal apertures and fastener apertures.

15. The pedal assembly of any of these embodiments, wherein the crank comprises a locking plate that is slidably mounted to the crank, the locking plate having a locked position wherein portions of the locking plate radially overlap portions of the pedal apertures, and an unlocked position wherein no portions of the locking plate radially overlap the pedal apertures.

16. The pedal assembly of any of these embodiments wherein, when moving between the locked and unlocked positions, the portions of the locking plate simultaneously overlap and retract from the pedal apertures, respectively.

17. The pedal assembly of any of these embodiments, wherein the locking plate defaults to the locked position by spring bias against the crank.

18. The pedal assembly of any of these embodiments, further comprising a plunger for spring actuating the locking plate adjacent a radial perimeter of the crank.

19. The pedal assembly of any of these embodiments, wherein the spindle comprises a circumferential slot for selectively engaging the locking plate adjacent to the pedal apertures.

20. The pedal assembly of any of these embodiments, wherein the circumferential slot is formed in a pedal pin that is mounted to the spindle.

This written description uses examples to disclose the embodiments, including the best mode, and also to enable those of ordinary skill in the art to make and use the invention. The patentable scope is defined by the claims, and can include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities can be performed in addition to those described. Still further, the order in which activities are listed is not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

It can be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, can mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items can be used, and only one item in the list can be needed. For example, "at least one of: A, B, and C" includes any of the following combinations: A, B, C, A and B, A and C, B and C, and A and B and C.

Also, the use of "a" or "an" is employed to describe elements and components described herein. This is done merely for convenience and to give a general sense of the scope of the invention. This description should be read to include one or at least one and the singular also includes the plural unless it states otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, sacrosanct or an essential feature of any or all the claims.

After reading the specification, skilled artisans will appreciate that certain features which are, for clarity, described herein in the context of separate embodiments, can also be provided in combination in a single embodiment. Conversely, various features that are, for brevity, described in the context of a single embodiment, can also be provided separately or in any subcombination. Further, references to values stated in ranges include each and every value within that range.

What is claimed is:

1. A pedal assembly for an exercise and rehabilitation device, the pedal assembly comprising:

a crank having a hub with an axis of rotation, a plurality of pedal apertures extending along a radial length of the crank, and a locking plate that is slidably mounted to the crank, the locking plate having a locked position wherein portions of the locking plate radially overlap portions of the pedal apertures, and an unlocked position wherein no portions of the locking plate radially overlap the pedal apertures;

a pedal having a spindle configured to be interchangeably and releasably mounted to the pedal apertures in the crank; and wherein the spindle comprises a circumferential slot for selectively engaging the locking plate adjacent to the pedal apertures.

2. The pedal assembly of claim 1, wherein the locking plate defaults to the locked position by spring bias against the crank.

3. The pedal assembly of claim 2, further comprising a plunger and a spring for actuating the locking plate adjacent a radial perimeter of the crank.

4. The pedal assembly of claim 1, further comprising a disk coaxial with the axis of rotation, a central aperture along the axis and a plurality of spokes extending radially from adjacent the central aperture toward a perimeter of the disk, and the disk is formed from a different material than the crank; and the crank is coupled to one of the spokes of the disk.

5. The pedal assembly of claim 4, wherein the disk has disk pedal apertures that are coaxial and not obstructed by the pedal apertures of the crank; and the crank is mounted in a radial slot of one of the spokes.

6. The pedal assembly of claim 1, wherein when moving between the locked and unlocked positions, the portions of the locking plate simultaneously radially overlap and retract relative to the pedal apertures, respectively.

7. The pedal assembly of claim 1, wherein the circumferential slot is formed in a pedal pin that is mounted to the spindle.

8. A pedal assembly for an exercise and rehabilitation device, the pedal assembly comprising:

a disk having an axis of rotation, a central aperture along the axis and a plurality of spokes extending radially from adjacent the central aperture toward a perimeter of the disk, and the disk is formed from a first material; and a crank coupled to one of the spokes of the disk, the crank having a hub concentric with the central aperture, and a plurality of pedal apertures extending along a radial length of the crank, and the crank is formed from a metallic material that differs from the first material;

a pedal having a spindle configured to be interchangeably and releasably mounted to the pedal apertures in the crank; and wherein the central aperture is complementary in shape to the hub, and the hub is detachable from the crank.

9. The pedal assembly of claim 8, wherein the crank comprises a locking plate that is slidably mounted to the crank, the locking plate having a locked position wherein portions of the locking plate radially overlap portions of the pedal apertures, and an unlocked position wherein no portions of the locking plate radially overlap the pedal apertures.

10. The pedal assembly of claim 9, wherein the locking plate defaults to the locked position by spring bias against the crank.

11. The pedal assembly of claim 10, further comprising a plunger for spring actuating the locking plate adjacent a radial perimeter of the crank.

12. The pedal assembly of claim 9, wherein when moving between the locked and unlocked positions, the portions of the locking plate simultaneously radially overlap and retract relative to the pedal apertures, respectively.

13. The pedal assembly of claim 8, wherein the spindle comprises a circumferential slot for selectively engaging the locking plate adjacent to the pedal apertures.

14. The pedal assembly of claim 13, wherein the circumferential slot is formed in a pedal pin that is mounted to the spindle.

15. The pedal assembly of claim 8, wherein the disk has disk pedal apertures that are coaxial and not obstructed by the pedal apertures of the crank.

16. The pedal assembly of claim 8, wherein the first material comprises a polymer.

17. The pedal assembly of claim 8, wherein only one of the spokes of the disk comprises a radial slot, the crank is mounted in the radial slot, and other ones of the spokes of the disk do not comprise a radial slot.

18. The pedal assembly of claim 8, wherein the disk is solid other than at the central aperture, disk pedal apertures and fastener apertures.

* * * * *